US011131236B2

(12) United States Patent
Lombard et al.

(10) Patent No.: US 11,131,236 B2
(45) Date of Patent: Sep. 28, 2021

(54) TURBOCHARGER HAVING ADJUSTABLE-TRIM CENTRIFUGAL COMPRESSOR INCLUDING DIVERGENT-WALL DIFFUSER

(71) Applicant: Garrett Transportation I Inc., Torrance, CA (US)

(72) Inventors: Alain Lombard, Vosges (FR); Quentin Roberts, Meurthe et Moselle (FR); Hani Mohtar, Lorraine (FR); Stephane Pees, Meurthe et Moselle (FR)

(73) Assignee: Garrett Transportation I Inc., Torrance, CA (US)

( * ) Notice: Subject to any disclaimer, the term of this patent is extended or adjusted under 35 U.S.C. 154(b) by 0 days.

(21) Appl. No.: 16/352,780

(22) Filed: Mar. 13, 2019

(65) Prior Publication Data

US 2020/0291851 A1 Sep. 17, 2020

(51) Int. Cl.
*F02B 37/22* (2006.01)
*F01D 17/14* (2006.01)
(Continued)

(52) U.S. Cl.
CPC ..... *F02B 37/225* (2013.01); *F01D 17/143* (2013.01); *F02B 39/16* (2013.01);
(Continued)

(58) Field of Classification Search
CPC .. F04D 27/02; F04D 27/0246; F04D 27/0253; F04D 29/44; F04D 29/441;
(Continued)

(56) References Cited

U.S. PATENT DOCUMENTS 3,860,360 A * 1/1975 Yu ..... F04D 29/441 415/208.3
5,529,457 A * 6/1996 Terasaki ..... F04D 29/444 415/208.3

(Continued)

FOREIGN PATENT DOCUMENTS

JP 58183899 A 10/1983
JP 2009236035 A 10/2009

OTHER PUBLICATIONS

Extended European Search Report for EP Appl. No. 20153223.1-1007, dated Jul. 24, 2020.

*Primary Examiner* — Mark A Laurenzi
*Assistant Examiner* — Mickey H France
(74) *Attorney, Agent, or Firm* — John C. James

(57) ABSTRACT

A centrifugal compressor for a turbocharger includes an inlet-adjustment mechanism in an air inlet for the compressor, operable to move between an open position and a closed position in the air inlet. Movement of the inlet-adjustment mechanism from the open position to the closed position is effective to shift the compressor's surge line to lower flow rates. The compressor includes a diffuser extending between an exducer of the compressor wheel and a volute for collecting pressurized air from the compressor. The diffuser is defined between first and second walls that diverge from each other in a radially outwardly direction through the diffuser. The divergent-wall diffuser enhances the shift of the surge line to lower flow rates when the inlet-adjustment mechanism is put in the closed position.

2 Claims, 6 Drawing Sheets

(51) Int. Cl.

| | |
|---|---|
| ***F04D 29/46*** | (2006.01) |
| ***F04D 27/02*** | (2006.01) |
| ***F04D 29/44*** | (2006.01) |
| ***F04D 25/04*** | (2006.01) |
| ***F04D 29/42*** | (2006.01) |
| ***F04D 29/66*** | (2006.01) |
| ***F02B 39/16*** | (2006.01) |

(52) U.S. Cl.
CPC ..... *F04D 25/045* (2013.01); *F04D 27/0253* (2013.01); *F04D 29/4206* (2013.01); *F04D 29/4213* (2013.01); *F04D 29/441* (2013.01); *F04D 29/464* (2013.01); *F04D 29/667* (2013.01); *F05D 2220/40* (2013.01); *F05D 2250/51* (2013.01)

(58) Field of Classification Search
CPC ..... F02B 2037/122; F02B 2037/125; F02B 37/22; F02B 37/225; F02B 2039/166; F02B 2039/168
USPC ..... 123/561; 60/600, 601, 611
See application file for complete search history.

(56) References Cited

U.S. PATENT DOCUMENTS

| | | | | |
|---|---|---|---|---|
| 2002/0106278 | A1* | 8/2002 | Koga | F04D 17/122 415/211.2 |
| 2005/0058535 | A1* | 3/2005 | Meshenky | F02B 29/0412 415/121.3 |
| 2013/0294903 | A1* | 11/2013 | Tomita | F04D 29/441 415/204 |
| 2015/0132120 | A1* | 5/2015 | Yoeda | F01D 9/026 415/204 |
| 2016/0076553 | A1* | 3/2016 | Bessho | F04D 29/681 415/204 |
| 2017/0298953 | A1* | 10/2017 | Lombard | F04D 29/462 |

* cited by examiner

TURBOCHARGER HAVING ADJUSTABLE-TRIM CENTRIFUGAL COMPRESSOR INCLUDING DIVERGENT-WALL DIFFUSER

BACKGROUND OF THE INVENTION

The present disclosure relates to centrifugal compressors, such as used in turbochargers, and more particularly relates to centrifugal compressors in which the effective inlet area or diameter can be adjusted for different operating conditions by means of an inlet-adjustment mechanism disposed in the air inlet for the compressor.

An exhaust gas-driven turbocharger is a device used in conjunction with an internal combustion engine for increasing the power output of the engine by compressing the air that is delivered to the air intake of the engine to be mixed with fuel and burned in the engine. A turbocharger comprises a compressor wheel mounted on one end of a shaft in a compressor housing and a turbine wheel mounted on the other end of the shaft in a turbine housing. Typically the turbine housing is formed separately from the compressor housing, and there is yet another center housing connected between the turbine and compressor housings for containing bearings for the shaft. The turbine housing defines a generally annular chamber that surrounds the turbine wheel and that receives exhaust gas from an engine. The turbine assembly includes a nozzle that leads from the chamber into the turbine wheel. The exhaust gas flows from the chamber through the nozzle to the turbine wheel and the turbine wheel is driven by the exhaust gas. The turbine thus extracts power from the exhaust gas and drives the compressor. The compressor receives ambient air through an inlet of the compressor housing and the air is compressed by the compressor wheel and is then discharged from the housing to the engine air intake.

Turbochargers typically employ a compressor wheel of the centrifugal (also known as "radial") type because centrifugal compressors can achieve relatively high pressure ratios in a compact arrangement. Intake air for the compressor is received in a generally axial direction at an inducer portion of the centrifugal compressor wheel and is discharged in a generally radial direction at an exducer portion of the wheel. The compressed air from the wheel passes through a diffuser before being delivered to a volute, and from the volute the air is supplied to the intake of an internal combustion engine.

The operating range of the compressor is an important aspect of the overall performance of the turbocharger. The operating range is generally delimited by a surge line and a choke line on an operating map for the compressor. The compressor map is typically presented as pressure ratio (discharge pressure Pout divided by inlet pressure Pin) on the vertical axis, versus corrected mass flow rate on the horizontal axis. The choke line on the compressor map is located at high flow rates and represents the locus of maximum mass-flow-rate points over a range of pressure ratios; that is, for a given point on the choke line, it is not possible to increase the flow rate while maintaining the same pressure ratio because a choked-flow condition occurs in the compressor.

The surge line is located at low flow rates and represents the locus of minimum mass-flow-rate points without surge, over a range of pressure ratios; that is, for a given point on the surge line, reducing the flow rate without changing the pressure ratio, or increasing the pressure ratio without changing the flow rate, would lead to surge occurring. Surge is a flow instability that typically occurs when the compressor blade incidence angles become so large that substantial flow separation arises on the compressor blades. Pressure fluctuation and flow reversal can happen during surge.

In a turbocharger for an internal combustion engine, compressor surge may occur when the engine is operating at high load or torque and low engine speed, or when the engine is operating at a low speed and there is a high level of exhaust gas recirculation (EGR). Surge can also arise when an engine is suddenly decelerated from a high-speed condition. Expanding the surge-free operation range of a compressor to lower flow rates is a goal often sought in compressor design.

Applicant is the owner of several patent applications (hereinafter, "the commonly owned Applications") describing various inlet-adjustment mechanisms for delaying the onset of surge to lower flow rates at a given compressor pressure ratio (i.e., shifting the surge line to the left on the compressor map), including but not limited to: application Ser. No. 14/642,825 filed on Mar. 10, 2015; Ser. No. 14/551,218 filed on Nov. 24, 2014; Ser. No. 14/615,428 filed on Feb. 6, 2016; Ser. No. 15/446,054 filed on Mar. 1, 2017; Ser. No. 15/446,090 filed on Mar. 1, 2017; Ser. No. 15/456,403 filed on Mar. 10, 2017; Ser. No. 15/836,781 filed on Dec. 8, 2017; Ser. No. 15/806,267 filed on Nov. 7, 2017; Ser. No. 15/822,093 filed on Nov. 24, 2017; Ser. No. 15/907,420 filed on Feb. 28, 2018; Ser. No. 15/904,493 filed on Feb. 26, 2018; and Ser. No. 15/909,899 filed on Mar. 1, 2018; the entire disclosures of all of said applications being hereby incorporated herein by reference. Inlet-adjustment mechanisms in accordance with said applications generally include a plurality of blades or vanes that collectively circumscribe an orifice whose effective diameter is adjustable by movement of the blades or vanes radially inwardly or outwardly. By adjusting the effective compressor inlet diameter to a reduced value at operating conditions where surge may be imminent, the surge line on the compressor map is shifted toward lower flow rates, thereby preventing surge from occurring at said operating conditions.

The present application is concerned with improvements to turbochargers having an inlet-adjustment mechanism generally of the type described above.

BRIEF SUMMARY OF THE DISCLOSURE

The present disclosure is directed to turbochargers having a centrifugal compressor and having an inlet-adjustment mechanism for the compressor that can enable the surge line for the compressor to selectively be shifted to the left (i.e., surge is delayed to a lower flow rate at a given pressure ratio). Applicant has discovered an unexpected synergy that exists between the operation of the inlet-adjustment mechanism and a modified diffuser configuration for the compressor. One embodiment described herein comprises a turbocharger having the following features:

a turbine housing and a turbine wheel mounted in the turbine housing and connected to a rotatable shaft for rotation therewith, the turbine housing receiving exhaust gas and supplying the exhaust gas to the turbine wheel;

a centrifugal compressor assembly comprising a compressor housing and a compressor wheel mounted in the compressor housing and connected to the rotatable shaft for rotation therewith, the compressor wheel having blades and defining an inducer portion and an exducer portion, the compressor housing having an air inlet wall defining an air inlet for leading air generally axially into the compressor wheel, the compressor housing further defining a volute for receiving compressed air discharged generally radially outwardly from the compressor wheel;

a compressor inlet-adjustment mechanism disposed in the air inlet of the compressor housing and adjustable between an open position and a closed position, the inlet-adjustment mechanism in the closed position forming an orifice of reduced diameter relative to a nominal diameter of the inlet; and the compressor housing defining a diffuser disposed between the exducer portion of the compressor wheel and the volute, the diffuser receiving the compressed air from the compressor wheel and diffusing the compressed air and delivering the diffused compressed air into the volute, wherein the diffuser is formed between a first wall and a second wall, and along at least a portion of a radial length of the diffuser the first and second walls diverge from each other in a radially outward direction.

Conventional centrifugal compressors typically include a diffuser that is formed between two walls that are parallel to each other. Although the axial spacing between the walls is constant along the flow direction through the diffuser, the flow area increases linearly with radius along the flow direction. In accordance with the invention, however, the flow area increases more rapidly than for parallel-wall diffusers because the axial spacing between the first and second walls increases in the radially outward direction along the diffuser. Unexpectedly, it has been found that when the divergent-wall diffuser is used in a compressor having an inlet-adjustment mechanism, closing of the inlet-adjustment mechanism results in a greater shift of the surge line to lower flow rates on the compressor map, in comparison with an otherwise identical compressor having a conventional parallel-wall diffuser. Yet when the inlet-adjustment mechanism is open, the divergent-wall diffuser has comparatively little effect on the compressor map.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 5A:
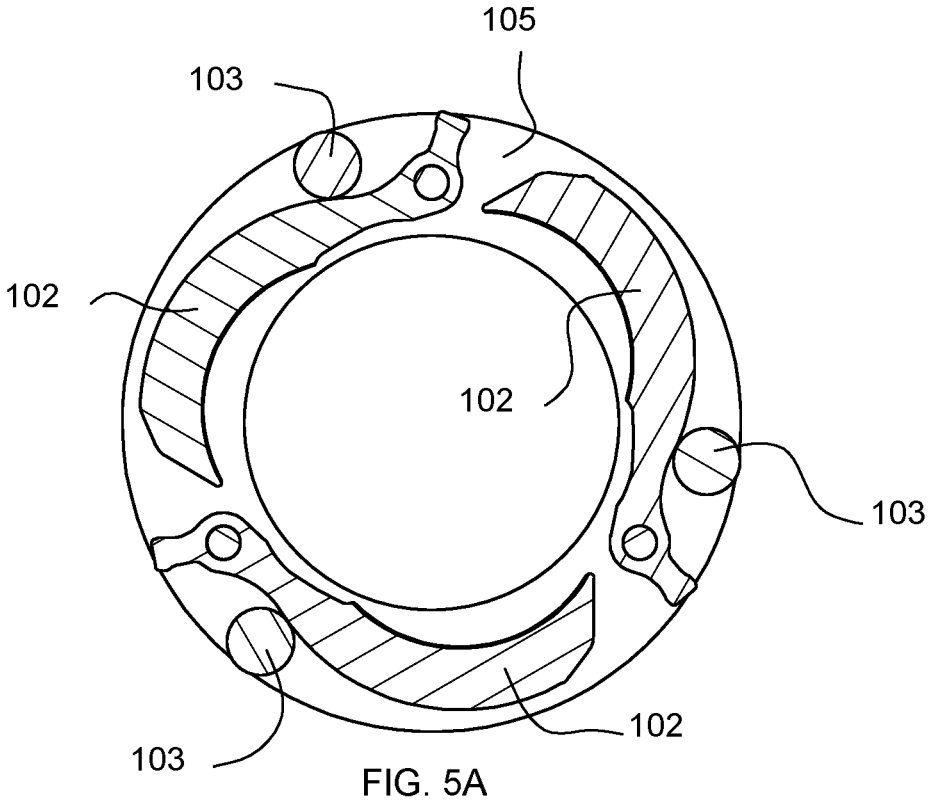
FIG. 5A is a cross-sectional view through the inlet-adjustment mechanism of FIG. 4, on a plane normal to the turbocharger axis, showing the mechanism in an open position.
Figure 5B:
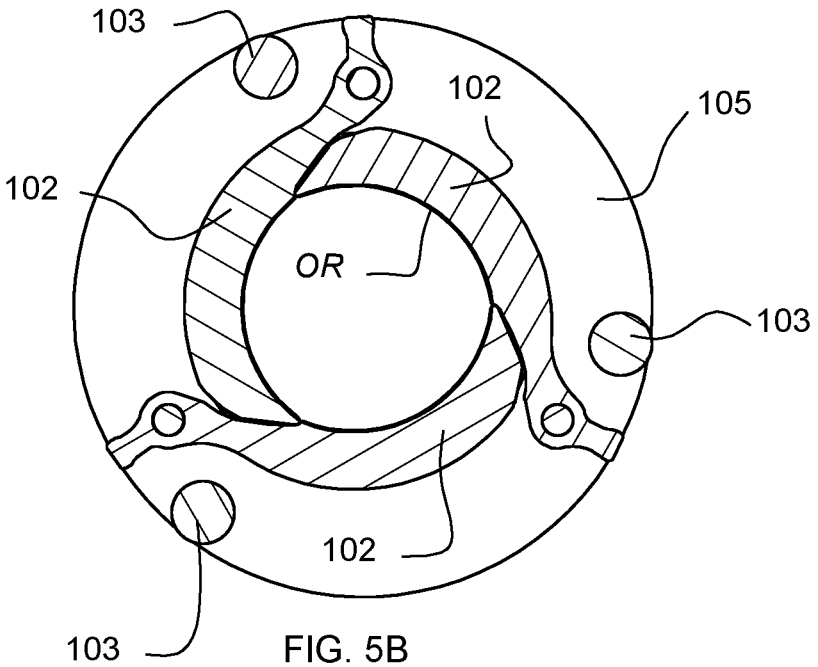
Figure 6:
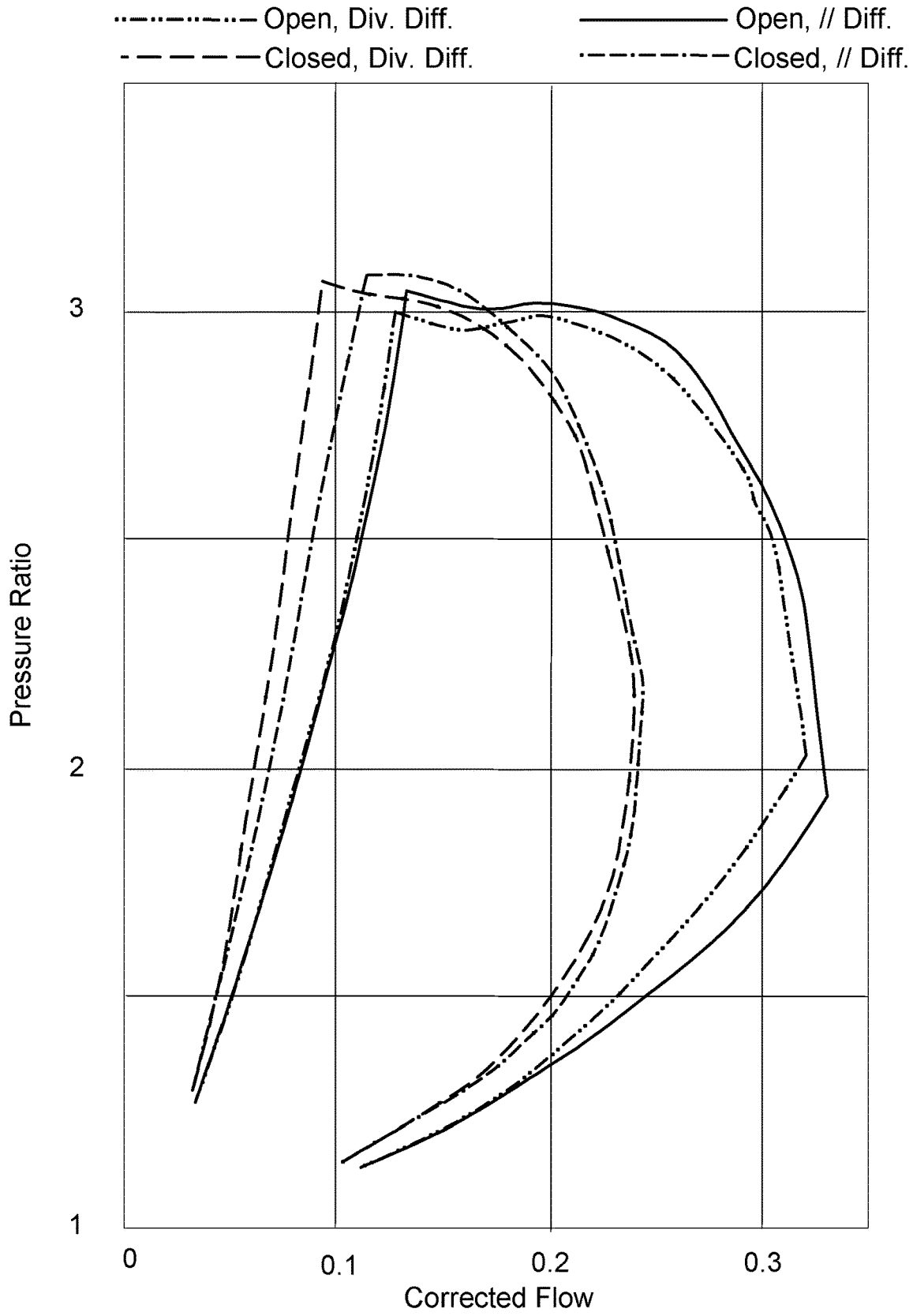

FIG. 5B is similar to FIG. 5A but shows the mechanism in a closed position; and FIG. 6 is a graph of bench test results of pressure ratio versus corrected flow for a compressor having a conventional parallel-wall diffuser, compared with a compressor having a divergent-wall diffuser in accordance with an embodiment of the invention, in each case operated with the inlet-adjustment mechanism in an open position and in a closed position.

DETAILED DESCRIPTION OF THE DRAWINGS

The present inventions now will be described more fully hereinafter with reference to the accompanying drawings, in which some but not all embodiments of the inventions are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
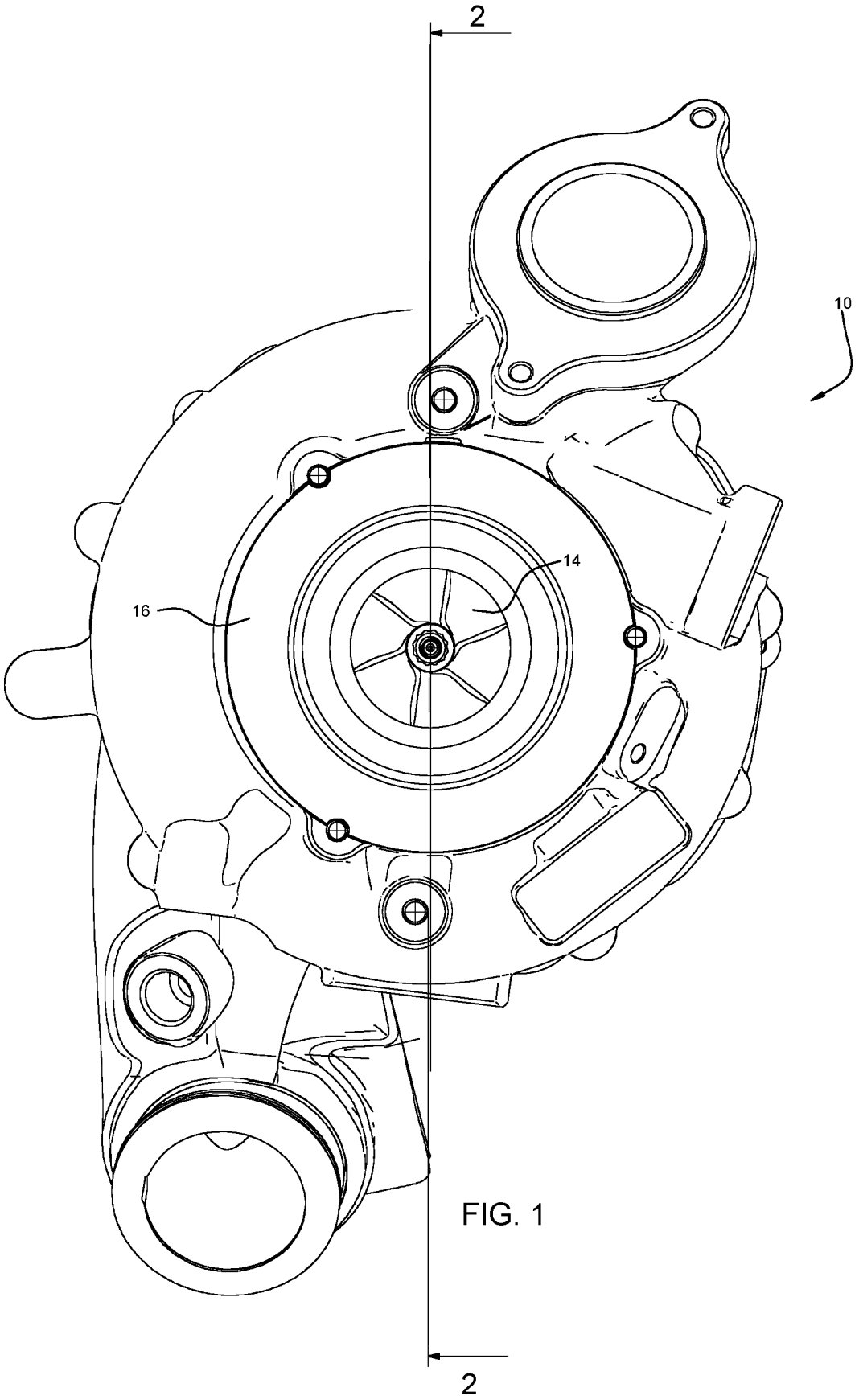
FIG. 1 is an end view of a turbocharger in accordance with one embodiment of the invention, looking axially from the compressor end toward the turbine end of the turbocharger.
Figure 2:
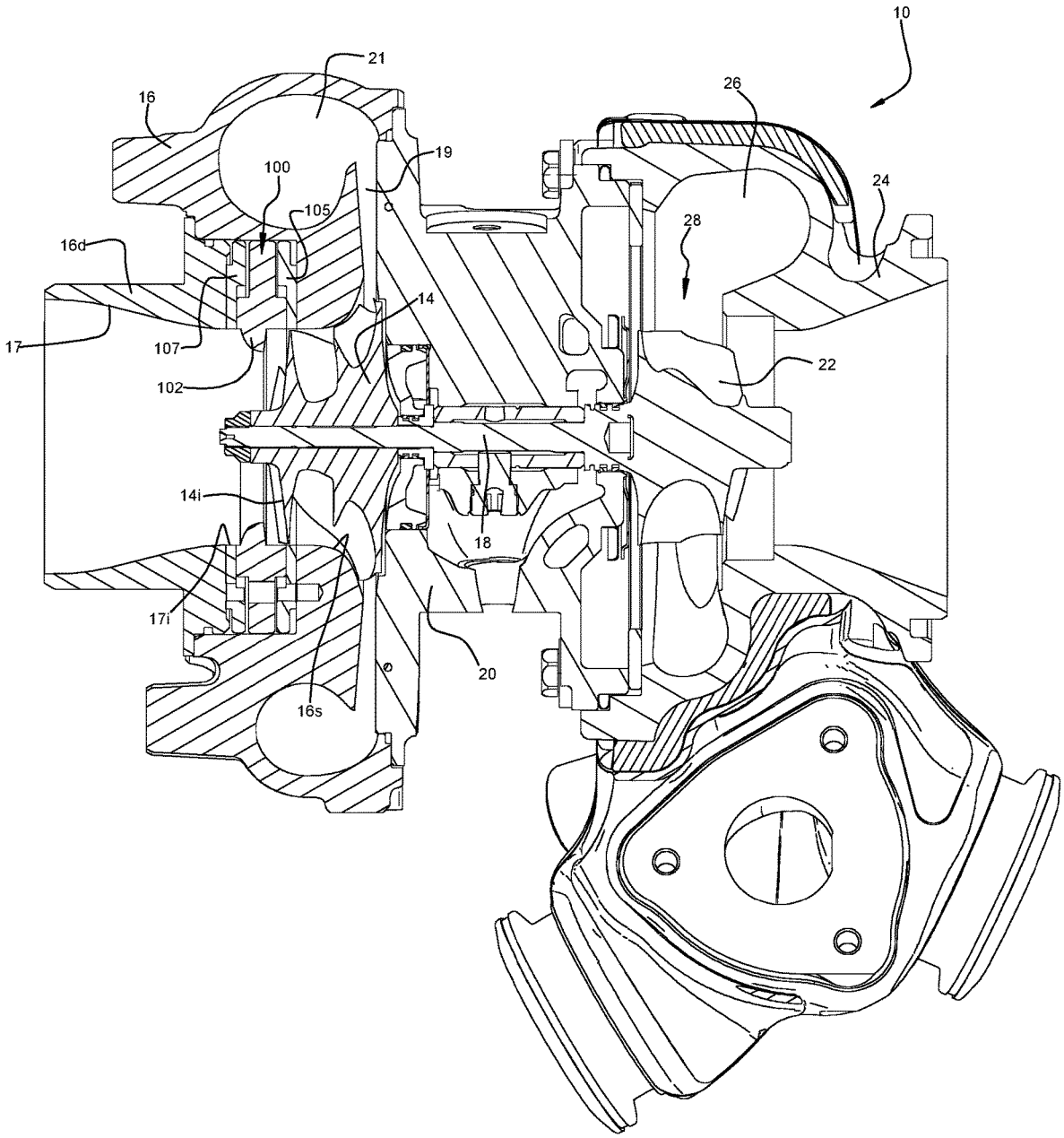
FIG. 2 is a cross-sectional view of the turbocharger along line 2-2 in FIG. 1.

A turbocharger 10 in accordance with one embodiment of the invention is illustrated in axial end view in FIG. 1, and an axial cross-sectional view of the turbocharger is shown in FIG. 2. The turbocharger includes a compressor and a turbine. The compressor comprises a compressor wheel or impeller 14 mounted in a compressor housing 16 on one end of a rotatable shaft 18. The compressor housing includes a wall that defines an air inlet 17 for leading air generally axially into the compressor wheel 14. The shaft is supported in bearings mounted in a center housing 20 of the turbocharger. The shaft is rotated by a turbine wheel 22 mounted on the other end of the shaft from the compressor wheel, thereby rotatably driving the compressor wheel, which compresses air drawn in through the compressor inlet and discharges the compressed air generally radially outwardly from the compressor wheel. The compressed air passes through a diffuser 19 before entering into a volute 21 for collecting the compressed air. From the volute 21, the air is routed to the intake of an internal combustion engine (not shown) for boosting the performance of the engine.

The turbine wheel 22 is disposed within a turbine housing 24 that defines an annular chamber 26 for receiving exhaust gases from an internal combustion engine (not shown). The turbine housing also defines a nozzle 28 for directing exhaust gases from the chamber 26 generally radially inwardly to the turbine wheel 22. The exhaust gases are expanded as they pass through the turbine wheel, and rotatably drive the turbine wheel, which in turn rotatably drives the compressor wheel 14 as already noted.

With reference to FIG. 2, in the illustrated embodiment, the wall that defines the air inlet 17 is formed in part by the compressor housing 16 and in part by a separate inlet duct member **16*d* that is received into a cylindrical receptacle defined by the compressor housing. The portion of the air inlet 17 proximate the compressor wheel 14 defines a generally cylindrical inner surface 17*i* that has a diameter generally matched to the diameter of an inducer portion 14*i*** of the compressor wheel.

The compressor housing 16 defines a shroud surface **16*s*** that is closely adjacent to the radially outer tips of the compressor blades. The shroud surface defines a curved contour that is generally parallel to the contour of the compressor wheel.

In accordance with the invention, the compressor of the turbocharger includes an inlet-adjustment mechanism 100 disposed in the air inlet 17 of the compressor housing. The inlet-adjustment mechanism is operable for adjusting an effective diameter of the air inlet into the compressor wheel. As such, the inlet-adjustment mechanism is movable between an open position and a closed position, and various points intermediate said positions.

Figure 4:
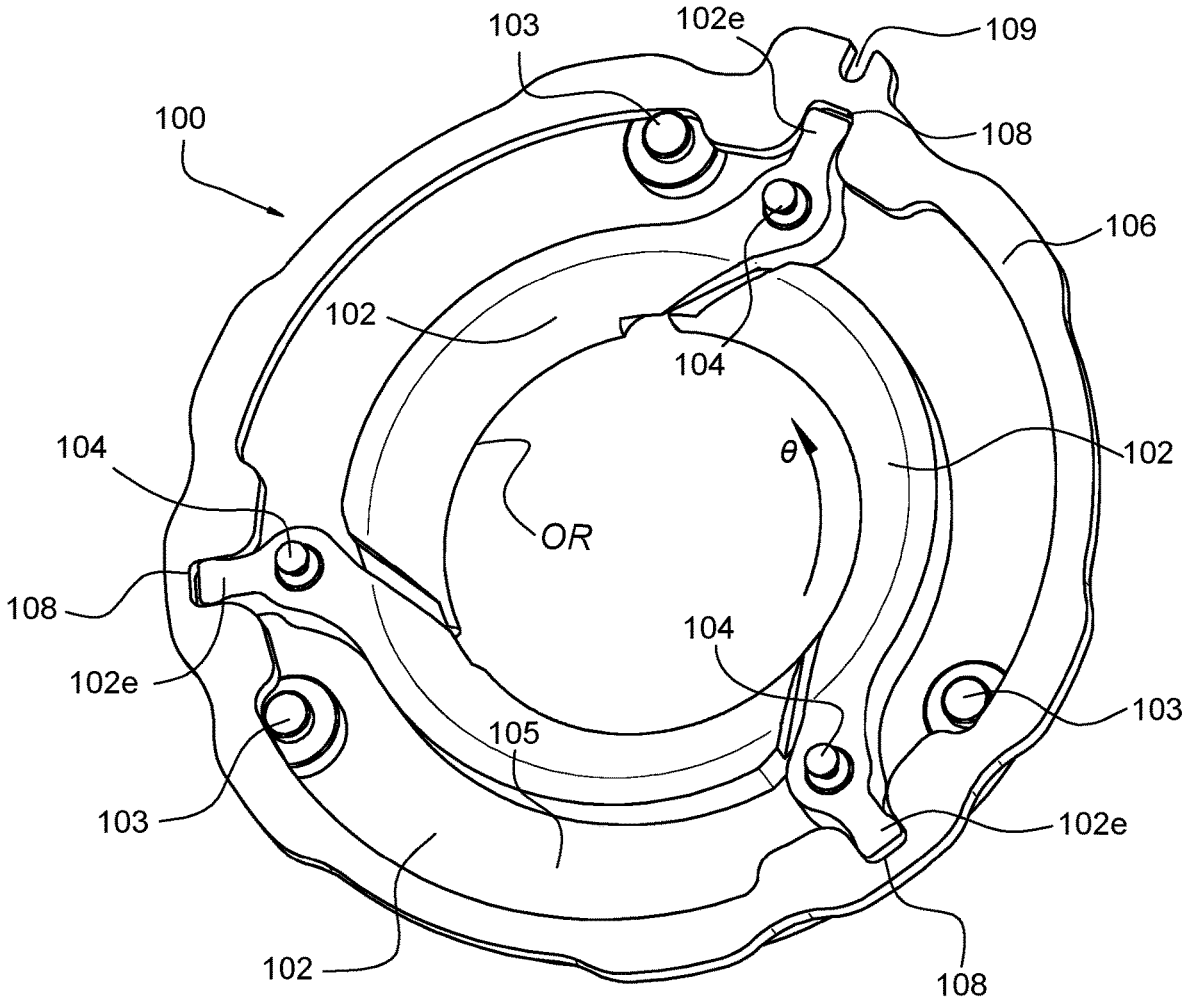
FIG. 4 is an isometric view of an exemplary inlet-adjustment mechanism usable in the practice of the invention.

With reference now to FIGS. 4, 5A, and 5B, in the illustrated embodiment the inlet-adjustment mechanism comprises a plurality of blades 102 arranged about the central axis of the air inlet and each pivotable about a pivot pin 104 located at or near one end of the blade. In the illustrated embodiment, the inlet-adjustment mechanism comprises a stand-alone assembly or "cartridge" having a pair of annular end plates 105 and 107. The pivot pins are secured in the annular end plate 105 and the blades are arranged to rest against the end plate. The assembly of the blades 102 and unison ring 106 is captively retained between the annular end plate 105 and the second opposite annular end plate 107. The pivot pins 104 can also serve the further function of axially spacing the two end plates apart from each other. A plurality of guides 103 are also secured in the end plate 105, or optionally can be secured in the other end plate 107 instead, or can be secured to both end plates. The guides are located so as to engage the circular inner periphery of a unison ring 106 that is substantially coplanar with the blades 102. (Optionally the guides 103 can engage the outer periphery of the unison ring if the end plate diameter is large enough to support the guides radially outward of the unison ring.) The guides 103 serve to guide the unison ring when it is rotated about its central axis (which coincides with the rotational axis of the turbocharger), so that the unison ring remains substantially concentric with respect to the end plate 105. The guides 103 can comprise rollers or fixed guide pins. The inner periphery of the unison ring defines a plurality of slots 108, equal in number to the number of blades 102. Each blade includes an end portion 102*e* that engages one of the slots 108, so that when the unison ring is rotated about its axis, the blades are pivoted about the pivot pins 104.

As shown in FIG. 2, the entire assembly is disposed in an annular space defined between the compressor housing 16 and the inlet duct member 16*d*. The two end plates 105 and 107 have an inner diameter matched to the diameter of the cylindrical inlet surface 17*i* proximate the inducer 14*i* of the compressor wheel, such that the two end plates are effectively part of the wall defining the air inlet 17, and such that the axial space between the two end plates effectively forms an opening or slot through the wall of the air inlet. The blades 102 are arranged to pass through this slot. The radially inner edges of the blades 102 include portions that preferably are generally circular arc-shaped and these edges collectively surround and bound a generally circular opening (although the degree of roundness varies depending on the positions of the blades, as further described below).

Alternatively, instead of a cartridge form of inlet-adjustment mechanism, the inlet-adjustment mechanism can comprise a non-cartridge assembly in which the pins 104 for the blades 102 are secured in the compressor housing 16 and/or the inlet duct member 16*d*. Stated differently, the end plate 105 becomes an integral portion of the compressor housing 16 and the other end plate 107 becomes an integral portion of the inlet duct member 16*d*.

The range of pivotal movement of the blades is sufficient that the blades can be pivoted radially outwardly (by rotation of the unison ring in one direction, clockwise in FIG. 4) to an open position as shown in FIG. 5A, in which the blades are entirely radially outward of the inner surface 17*i* of the inlet. As such, in the open position of the blades, the inlet-adjustment mechanism does not alter the nominal inlet diameter as defined by the inlet surface 17*i*. Optionally, the guides 103 can serve also as stops for limiting the radially outward pivoting of the blades to the open position.

The blades can also be pivoted radially inwardly (by rotation of the unison ring in the opposite direction, counterclockwise in FIG. 4) to a closed position as shown in FIG. 5B. In the closed position, the circular-arc edges along the radially inner sides of the blades collectively form an orifice OR having a diameter that is less than that of the inlet surface 17*i*. This has the consequence that the effective diameter of the inlet is reduced relative to the nominal inlet diameter. Furthermore, the blades can be pivoted to any of various intermediate positions between the open and closed positions as desired. In this manner, the inlet-adjustment mechanism is able to regulate the effective diameter of the air inlet approaching the compressor wheel.

The invention is not limited to inlet-adjustment mechanisms having arcuate pivotable blades as shown. Various other types of inlet-adjustment mechanisms can be used in the practice of the present invention, including but not limited to the mechanisms described in the commonly owned Applications as previously noted and incorporated herein by reference.

At low flow rates (e.g., low engine speeds), the inlet-adjustment mechanism 100 can be placed in the closed position of FIG. 5B. This can have the effect of reducing the effective inlet diameter and thus of increasing the flow velocity into the compressor wheel. The result will be a reduction in compressor blade incidence angles, effectively stabilizing the flow (i.e., making blade stall and compressor surge less likely). In other words, the surge line of the compressor will be moved to lower flow rates (to the left on a map of compressor pressure ratio versus flow rate).

At intermediate and high flow rates, the inlet-adjustment mechanism 100 can be partially opened as in FIG. 5A. This can have the effect of increasing the effective inlet diameter so that the compressor regains its high-flow performance and choke flow essentially as if the inlet-adjustment mechanism were not present and as if the compressor had a conventional inlet matched to the wheel diameter at the inducer portion of the wheel.

Figure 3:
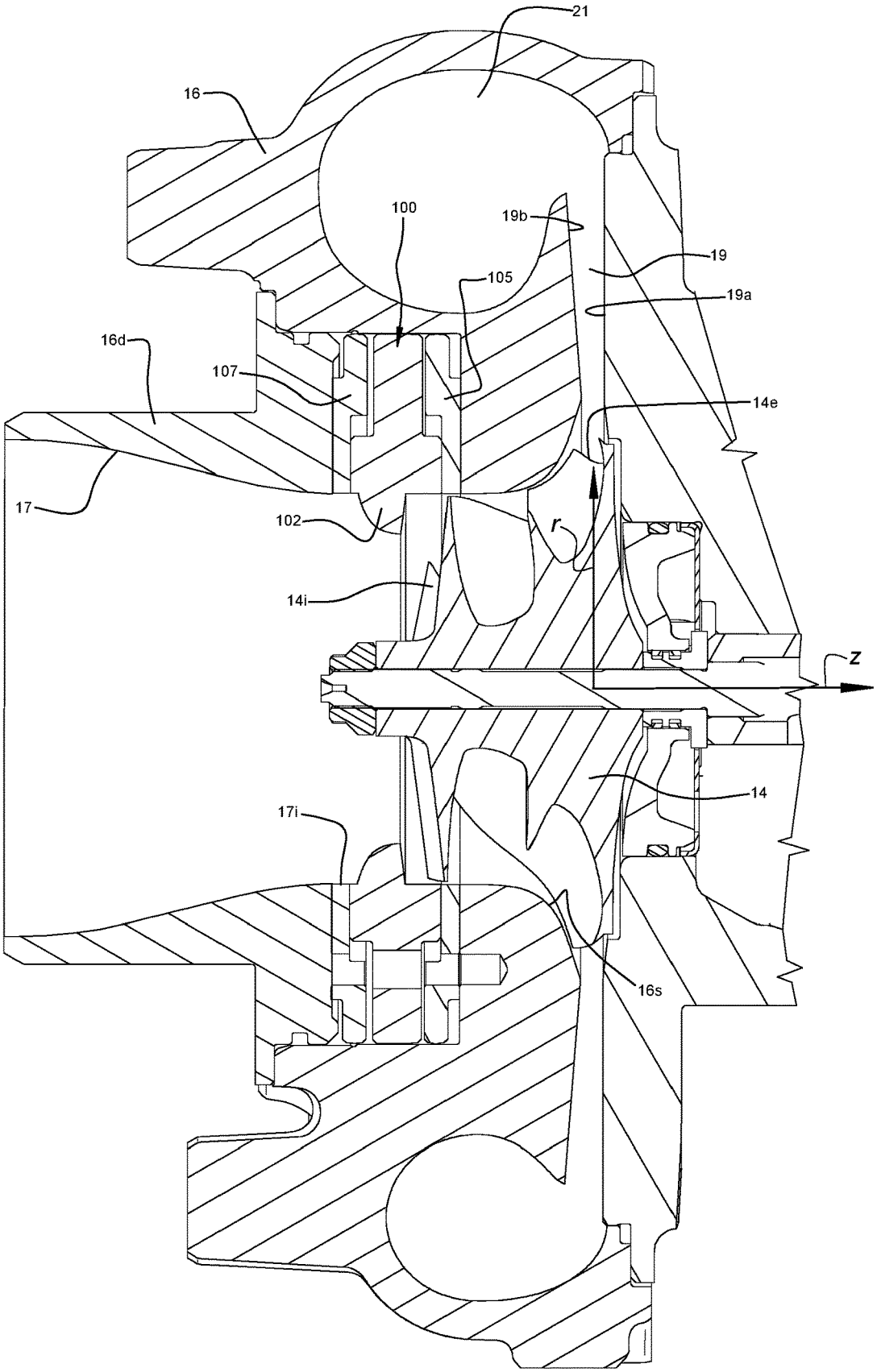
FIG. 3 is cross-sectional view of a compressor portion of the turbocharger of FIG. 1.

In accordance with the invention, an unexpected synergy is achievable between the operation of the inlet-adjustment mechanism 100 and the diffuser 19 because the diffuser is a divergent-wall diffuser. With reference to FIG. 3, unlike a conventional diffuser formed between two parallel walls, at least a portion of the radial length of the diffuser 19 is formed between a first wall 19*a* and a second wall 19*b* that diverge from each other in the radially outward direction. That is, the axial spacing between the first and second walls increases in the radially outward direction indicated by the radial axis r in FIG. 3. It is not essential that the walls diverge over the entire radial length of the diffuser, but over at least part of the length the walls must diverge. Consequently, the rate of diffusion through the diffuser is increased relative to a parallel-wall diffuser. The divergent-wall diffuser has been found in bench tests to have a beneficial effect on how the inlet-adjustment mechanism 100 performs when adjusted to the closed position.

FIG. 6 is a graph of pressure ratio verses corrected flow rate through the compressor, for two different configurations of compressors. One compressor had a conventional parallel-wall diffuser and an inlet-adjustment mechanism generally of the type illustrated and described herein. The second compressor was otherwise identical, except for having a divergent-wall diffuser in which the second wall 19*b* was conical with a cone half-angle of about 4.5 degrees, substantially as shown in FIG. 3. The first wall 19*a* was lying in an rθ plane. Each compressor was operated with the inlet-adjustment mechanism in an open position and in a closed position. In FIG. 6, the baseline configuration (parallel-wall diffuser) is shown in a solid line for the inlet-adjustment mechanism open, and in a dash-dash-dot line for the mechanism closed. The configuration in accordance with an embodiment of the invention (divergent-wall diffuser) is shown in a dot-dot-dash line for the inlet-adjustment mechanism open, and in a dash-dash line for the mechanism closed.

The test results were unexpected. It can be seen that with the inlet-adjustment mechanism open, the surge lines for the parallel-wall diffuser and the divergent-wall diffuser are nearly the same. However, when the inlet-adjustment mechanism is closed, the amount by which the surge line is shifted to lower flow rates with the divergent-wall diffuser is substantially larger than the shift with the parallel-wall diffuser. These results are not yet fully understood, but it is theorized that at low flow rates, flow separation occurs on the divergent wall 19*b* because of the rapid diffusion that would be demanded by the divergent-wall diffuser, and the flow separation zone results in the effective width of the diffuser actually being reduced. It is thought that this flow-separation effect is substantially more-pronounced when the inlet-adjustment mechanism is closed because of the higher flow velocity leaving the compressor exducer 14*e* (FIG. 3) and entering the diffuser 19. Hence, the diffuser acts to further increase the flow velocity through the compressor (basically augmenting the velocity increase caused by the closed inlet-adjustment mechanism), thereby further delaying surge to even lower flow rates relative to the parallel-wall diffuser.

In any case, regardless of the specific fluid mechanics occurring, the test results clearly indicate a substantial benefit in terms of delay of surge with the divergent-wall diffuser.

Many modifications and other embodiments of the inventions set forth herein will come to mind to one skilled in the art to which these inventions pertain having the benefit of the teachings presented in the foregoing descriptions and the associated drawings. For example, although in the illustrated embodiment the divergent-wall diffuser has a first wall 19*a* that is radial and a second wall 19*b* that is conical, the invention is not limited to any particular wall shapes for achieving the divergent diffuser. One wall or both walls can be non-radial (i.e., inclined with respect to an rθ plane), and non-conical walls can be employed. Additionally, in the illustrated embodiment, the divergent wall 19*b* is inclined with respect to an rθ plane all the way to the exit of the diffuser. In other embodiments, however, the diffuser can include a portion that has parallel walls, and the parallel-wall portion can be located anywhere along the radial length of the diffuser. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A turbocharger, comprising:

a turbine housing and a turbine wheel mounted in the turbine housing and connected to a rotatable shaft for rotation therewith about a turbocharger axis, the turbine housing receiving exhaust gas and supplying the exhaust gas to the turbine wheel;

a centrifugal compressor assembly comprising a compressor housing and a compressor wheel mounted in the compressor housing and connected to the rotatable shaft for rotation therewith about the turbocharger axis, the compressor wheel having blades and defining an inducer portion and an exducer portion, the compressor housing having an air inlet wall defining an air inlet for leading air generally axially into the compressor wheel along an axial flow direction, the compressor housing further defining a volute for receiving compressed air discharged generally radially outwardly from the compressor wheel; and a compressor inlet-adjustment mechanism disposed in the air inlet of the compressor housing and adjustable between an open position and a closed position, the inlet-adjustment mechanism in the closed position forming an orifice of reduced diameter relative to a nominal diameter of the inlet;

the compressor housing defining a vaneless diffuser disposed between the exducer portion of the compressor wheel and the volute, the diffuser receiving the compressed air from the compressor wheel and diffusing the compressed air and delivering the diffused compressed air into the volute, wherein the vaneless diffuser is formed between a first wall located relatively downstream with respect to the axial flow direction and a second wall spaced upstream from the first wall with respect to the axial flow direction, and wherein the second wall is conical so as to proceed axially opposite to the axial flow direction as the second wall extends in a radially outward direction, such that the first and second walls diverge from each other in the radially outward direction.

2. The turbocharger of claim 1, wherein the first wall lies in an r-θ plane with respect to an rθz cylindrical coordinate system in which r defines a radial direction with respect to the turbocharger axis, θ defines a circumferential direction about the turbocharger axis, and z defines an axial direction along the turbocharger axis.

* * * * *